US010132131B2

(12) United States Patent
Vick, Jr.

(10) Patent No.: US 10,132,131 B2
(45) Date of Patent: Nov. 20, 2018

(54) PULLING TOOL ELECTROMECHANICAL ACTUATED RELEASE

(71) Applicant: HALLIBURTON ENERGY SERVICES, INC., Houston, TX (US)

(72) Inventor: James Dan Vick, Jr., Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 138 days.

(21) Appl. No.: 14/907,772

(22) PCT Filed: Mar. 5, 2015

(86) PCT No.: PCT/US2015/018990

§ 371 (c)(1),
(2) Date: Jan. 26, 2016

(87) PCT Pub. No.: WO2016/140678

PCT Pub. Date: Sep. 9, 2016

(65) Prior Publication Data

US 2017/0030159 A1 Feb. 2, 2017

(51) Int. Cl.

| | |
|---|---|
| ***E21B 31/12*** | (2006.01) |
| ***E21B 47/06*** | (2012.01) |
| ***E21B 31/20*** | (2006.01) |
| ***E21B 31/107*** | (2006.01) |
| ***E21B 23/00*** | (2006.01) |

(52) U.S. Cl.

CPC ..... *E21B 31/12* (2013.01); *E21B 23/00* (2013.01); *E21B 31/107* (2013.01); *E21B 31/20* (2013.01); *E21B 47/06* (2013.01)

(58) Field of Classification Search

CPC ..... E21B 23/00; E21B 23/14; E21B 31/00; E21B 31/20

See application file for complete search history.

(56) References Cited

U.S. PATENT DOCUMENTS

| | | | |
|---|---|---|---|
| 2,862,560 | A | 12/1958 | Bostock et al. |
| 3,051,239 | A | 8/1962 | Dollison |
| 4,030,544 | A | 6/1977 | Ahlstone |
| 4,767,145 | A | 8/1988 | Bullard |
| 5,133,412 | A | 7/1992 | Coronado |

(Continued)

FOREIGN PATENT DOCUMENTS

| | | |
|---|---|---|
| WO | 1998026154 | 6/1998 |

OTHER PUBLICATIONS

International Search Report and Written Opinion dated Nov. 24, 2015 in International Application No. PCT/US2015/018990.

*Primary Examiner* — D. Andrews
*Assistant Examiner* — Jonathan Malikasim
(74) *Attorney, Agent, or Firm* — Polsinelli PC

(57) ABSTRACT

A drilling well pulling tool comprising a longitudinal body having an inner cavity. A sleeve is slideably disposed about a portion of the longitudinal body, the sleeve moveable from a first position to a second position. A dog member is retractable from an extended position to a retracted position relative the body when the sleeve is moved from the first position to the second position. A release lug abuts and resists movement of the sleeve from the first position, the lug releasable to the inner cavity thereby permitting slideable movement of the sleeve. An electromechanical actuator releases the release lug upon actuation.

19 Claims, 9 Drawing Sheets

(56) References Cited

U.S. PATENT DOCUMENTS

| | | | | |
|---|---|---|---|---|
| 5,168,623 | A | 12/1992 | Rabe | |
| 5,197,773 | A | 3/1993 | Vick | |
| 6,152,219 | A | 11/2000 | Vick | |
| 6,328,112 | B1 * | 12/2001 | Malone | E21B 21/10 166/332.1 |
| 7,051,810 | B2 * | 5/2006 | Clemens | E21B 31/00 166/117.6 |
| 7,426,964 | B2 | 9/2008 | Lynde | |
| 8,201,623 | B2 | 6/2012 | O'brien | |
| 8,215,386 | B2 | 7/2012 | Manke | |
| 8,794,311 | B2 | 8/2014 | Lauderdale | |
| 2005/0056427 | A1 | 3/2005 | Clemens et al. | |
| 2011/0056678 | A1 | 3/2011 | O'Brien | |
| 2013/0153203 | A1 | 6/2013 | Lauderdale | |

* cited by examiner

PULLING TOOL ELECTROMECHANICAL ACTUATED RELEASE

CROSS-REFERENCE TO RELATED APPLICATIONS

This application is a national stage entry of PCT/US2015/018990 filed Mar. 5, 2015, said application is expressly incorporated herein in its entirety.

FIELD

The present disclosure relates generally to well bore servicing operations. In particular, the subject matter herein generally relates to pulling and running tools for servicing a well bore.

BACKGROUND

During various phases of oil and gas operations it becomes necessary to place or withdrawing downhole devices from within a well bore. These are often referred to as "running" or "pulling" operations. For example, after drilling a well bore and withdrawing hydrocarbons, it may be necessary to place a plug in a portion of tubing or casing in a well bore and thereafter remove it. A pulling tool can be used for such operations.

In order to withdraw a downhole device from a wellbore, the pulling tool is often provided via wireline to contact and grab hold of the device, and then pulled toward the surface. At times, the downhole device may be difficult to dislodge from its location. In order to dislodge the device, jarring operations are conducted. If dislodging the device is unsuccessful, the pulling tool must be released and brought to the surface.

Releasing the pulling tool from the device often involves a particular upward and/or downward jarring sequence in order to sever shearable pins within the pulling tool device. Therefore, releasing the pulling tool can sometimes be difficult since the jarring must be sufficient strong and in a particular order. Furthermore, because dislodging a stuck downhold device using the pulling tool also involves jarring, the pulling tool can be accidentally released prematurely. Such difficulties can lead to longer servicing time and increased costs.

BRIEF DESCRIPTION OF THE DRAWINGS

Implementations of the present technology will now be described, by way of example only, with reference to the attached figures, wherein.

DETAILED DESCRIPTION

Figure 1:
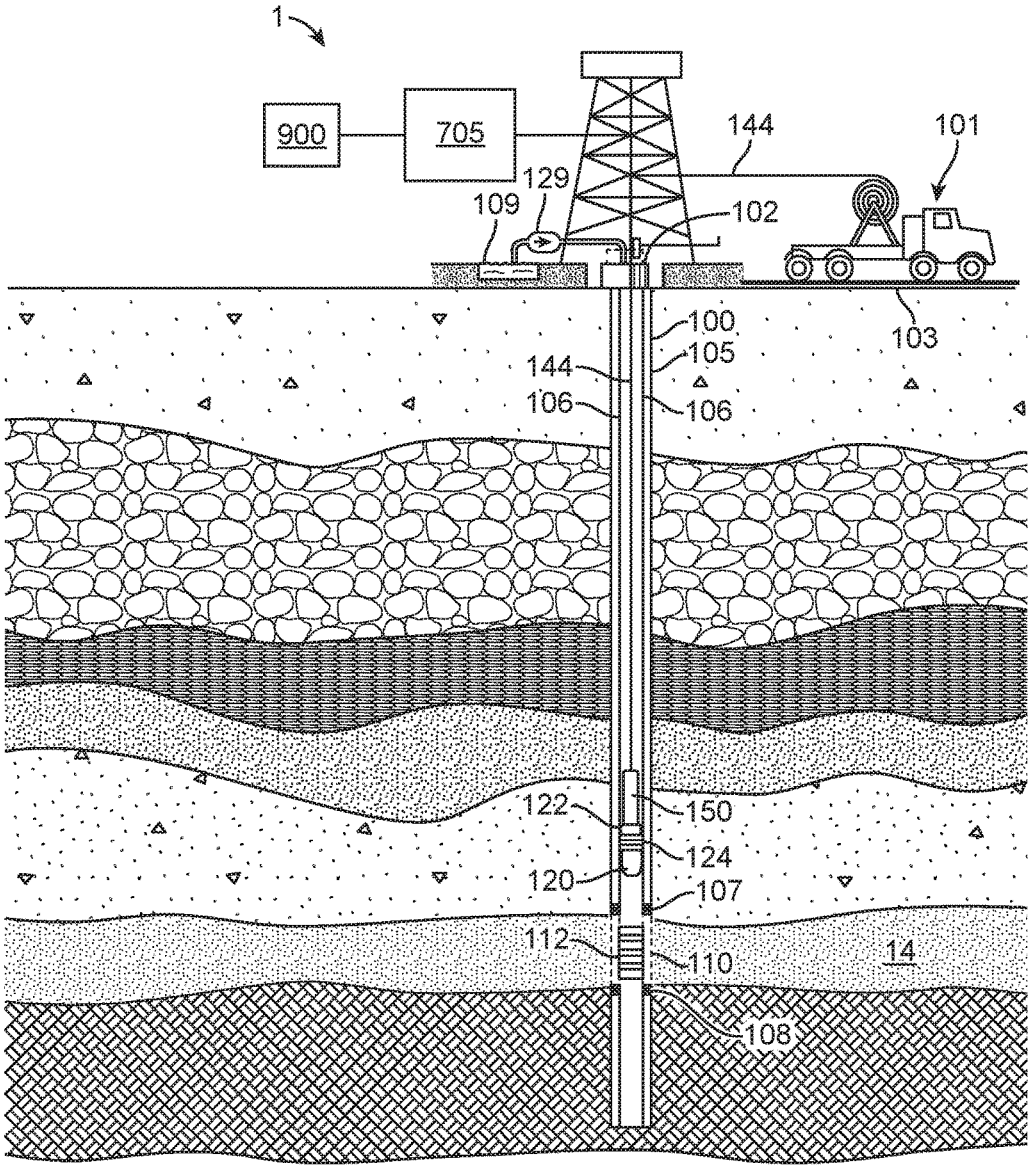
FIG. 1 is a diagram illustrating an exemplary environment for a pulling tool according to the disclosure herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side or bottom of the page is downhole compared to the left-hand side, further the top of the page is toward the surface, and the lower side of the page is downhole. Further the terms "proximal" here refer directionally to portions further toward the surface in relation to "distal" which refers directionally downhole and away from the surface in a downhole environment. A "processor" as used herein is an electronic circuit that can make determinations based upon inputs. A processor can include a microprocessor, a microcontroller, and a central processing unit, among others. While a single processor can be used, the present disclosure can be implemented over a plurality of processors.

Several definitions that apply throughout this disclosure will now be presented. The term "coupled" is defined as connected, whether directly or indirectly through intervening components, and is not necessarily limited to physical connections. The term "communicatively coupled" is defined as connected, either directly or indirectly through intervening components, and the connections are not necessarily limited to physical connections, but are connections that accommodate the transfer of data between the so-described components. The connection can be such that the objects are permanently connected or releasably connected. The term "outside" refers to a region that is beyond the outermost confines of a physical object. The term "axially" means substantially along a direction of the axis of the object. If not specified, the term axially is such that it refers to the longer axis of the object. The terms "comprising," "including" and "having" are used interchangeably in this disclosure. The terms "comprising," "including" and "having" mean to include, but not necessarily be limited to the things so described.

Disclosed herein is a pulling tool to "run" a downhole device in to a well or "pull" a downhole device from within a well. The term "run" or "running" with respect to the pulling tool disclosed herein means to insert a downhole device into a wellbore using the pulling tool. Additionally, the term "pull" or "pulling" with respect to the pulling tool means to draw a downhole device within a wellbore upwards toward the surface. When referring to the wellbore, the downhole device can be pulled or run in a tubing, casing, or other structure, or an empty wellbore itself.

The pulling tool disclosed herein can be attached to a downhole device and used for running or pulling the downhole device in a wellbore. The pulling tool has a body having a sleeve slidably disposed about a portion of the body. The pulling tool also has one or more dog members on its lower end which engage a fishing neck of a downhole device. A bias is provided which urges the sleeve upward toward the upper end of the tool. Movement of the sleeve is resisted by a release lug extending a distance above the surface of the tool body and which abuts the sleeve.

The release lug can be released upon actuation of an electromechanical actuator. Upon release, the release lug moves radially inward, thereby permitting movement of the sleeve. With release of the lug and movement of the sleeve, the one or more dogs are retracted from an extended position to a retracted position. The pulling tool can then be freely brought to the surface.

As noted, the pulling tool is released from the downhole device is released by employment of an electromechanical actuator. The electromechanical actuator can release can be an electrical motor, for example a stepper motor, a stepper motor with a linear drive, or a Piezoelectric motor. Any electrical motor can be employed for directly or indirectly releasing the release lug. Moreover, with employment of the electromechanical actuator, release can be conducted based on any variety of factors or conditions. For example, a timer for actuation and resulting release can be employed, as well as a particular detected pressure, pressure sequence, command from the surface, or a particular jarring sequence (using an accelerometer for example). In other examples, the mechanical actuator can include a battery which melts a pin which releases a biased plunger to further release the releasable lug.

The pulling tool can be employed in an exemplary wellbore system 1 shown for example in FIG. 1, a system for drilling a wellbore 100 includes a wellhead 102 at the surface 103. The wellbore 100 extends and penetrates various earth strata including formation 14. A truck 101 has a wireline 144 extending into the wellbore 100. It should be noted that while FIG. 1 generally depicts a land-based operation, those skilled in the art will readily recognize that the principles described herein are equally applicable to subsea operations that employ floating or sea-based platforms and rigs, without departing from the scope of the disclosure.

Disposed within the wellbore 100 is a casing 105 that can be cemented in place. The cement is therefore provided in the annulus between the casing 105 and the walls of the wellbore 100. Disposed within the casing 105 and extending from the wellhead 102 is a production tubing 106. A pump 129 is provided which pumps mud 109, or production fluid, into wellhead 102. A pair of seal assemblies 107, 108 provide a seal between the tubing 106 and casing 105 to prevent the flow of production fluids therebetween. During production, formation fluids enter the wellbore 100 through perforations 110. The perforations are made prior to production by punching holes in the casing 105 and formation by use of a perforating gun. By this method, fractures are made within the formation 14, which can be propped open by propants. During production, formation fluids (such as hydrocarbons) enter wellbore 100 through perforations 110 and sand control screen 112 to travel into tubing 106 for transmission to wellhead 102.

After drilling the wellbore, and before, during or after production, various downhole devices can be placed in the well system 1 and then retrieved. The pulling tool 150 disclosed herein can be used to run or pull the downhole devices in the wellbore 100. For example, in one illustrative example, the downhole device can be a plug 120. Although the pulling tool 150 is used for running and pulling plug 120 as discussed herein, the same can be applied to any downhole device, including flow controllers, chokes, valves, safety devices, drilling or recording devices.

For instance, when it is desired to shut the well system 1 for an extended period of time, plug 120 can be inserted into the tubing 106. This is achieved by running plug 120 downhole via wireline 144 or other conveyance using the pulling tool 150 disclosed herein. Plug 120 has lock mandrel 122 so as to attach to the pulling tool 150 at the lower end of wireline 144. During installation, lock mandrel 122 is run thorough landing nipple 124. Lock mandrel 122 is then pulled upwardly through landing nipple 124 such that the lock mandrel 122 engages a profile within landing nipple 124. This therefore sets plug 120 and lock mandrel 122 in place thereby terminating the flow of hydrocarbons. The plug 120 can be released from the lock mandrel 122 as disclosed herein and returned to the surface.

Alternatively, or additionally, when it is desired to reestablish production from the formation 14, plug 120 must be removed from the tubing 106. This is achieved by running pulling tool 150 downhole via wireline 144. Once the pulling tool 150 reaches the lock mandrel 122, the pulling tool 150 can engage the fishneck of the mandrel 122, and then draw it toward the surface.

In the above example, the pulling tool 150 needs to be released from the downhole device after setting the device. Additionally, if upon pulling the downhole device toward the surface the downhole device gets stuck, the surface operators may need to release the pulling tool. As described herein, the pulling tool 150 employs an electromechanical actuator to actuate release of the pulling tool 150 from the downhole device.

Figure 2:
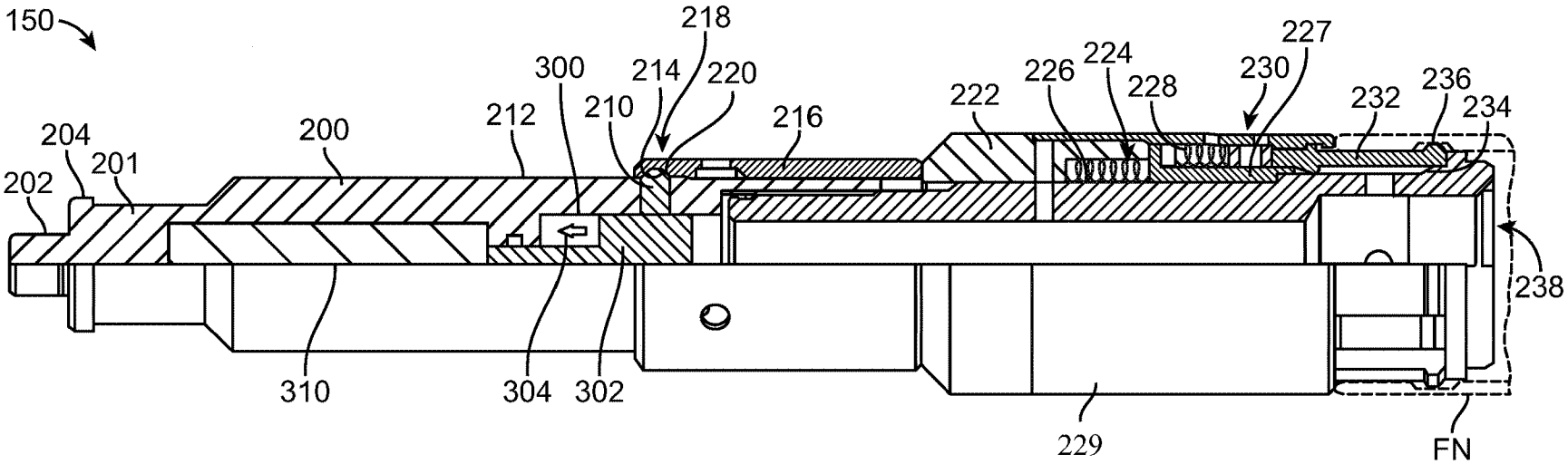
FIG. 2 is a diagram illustrating an exemplary pulling tool.

Illustrated in FIG. 2 is one example of pulling tool 150. Pulling tool 150 is depicted horizontally in the FIG. 1 wherein the left side would extend toward the surface, and the right side extends downhole away from the surface when inserted in a wellbore. As shown in FIG. 1, pulling tool 150 has a longitudinal body 200 with an upper body 201 having a threaded connector 202 on its upper end. The pulling tool 150 itself has a fishing neck with a flange 204. Further shown is a release lug 210, which is illustrated in its unreleased configuration and has a portion thereof extending beyond the outer surface 212 of the body 200. By extending beyond the surface 212, a portion of the release lug 210 abuts and resists movement of sleeve 216.

The sleeve 216 is slideably disposed about a portion of the longitudinal body 200. The sleeve 216 has a groove 218 on its underside in which a portion of the release lug 210 engages. The release lug 210 has a cam surface 214, which correspondingly contacts the cam surface 220 of the sleeve 216. The sleeve 216 extends distally toward the lower end of the pulling tool 150 and engages a skirt 222. The skirt 222 is disposed over a lower body portion 229 of the pulling tool 150. The skirt 222 has a bore 224 in which a bias 226 resides. Although illustrated as spring in FIG. 2, the bias 226 can be any device or mechanism which provides a force to urge the skirt 222 and sleeve 216 proximally toward the top of the pulling tool 100. When the release lug 210 is in an unreleased configuration, the bias 226 is compressed thereby providing urging force to the sleeve 216.

The release lug 210, as it extends above the outer surface 212 and into groove 218, thereby abuts and resists movement of the sleeve 216 urged upwards by the bias 226. The lower end of bias 226 abuts against a spacer 227 of the lower body portion 229. A lower weaker bias 228 is provided in an aperture 230 as shown in FIG. 2. The weaker bias 228 biases the dogs 232 downwardly such that their lower end contacts the shoulder 234. The shoulder 234 causes the dogs 232 to extend outwardly to an extended position. Each dog 232 has a projection 236 which is shaped to fit into a fishneck FN of a downhole device, or lock mandrel of a downhole device such as a plug. A threaded internal connector 238 is provided at the lower end of the pulling tool 150 so as to receive any prongs of a lock mandrel.

Within the upper body 200 is an inner cavity 300. The inner cavity 300 contains a plunger 302. The inner cavity 300 is spaced larger than plunger 302 such that plunger 302 can slideably move within the inner cavity 300. When the release lug 210 is in an unreleased configuration it rests on plunger 302 which blocks its movement into inner cavity 300. Accordingly, the plunger 302 abuts and resists the lug 210 from being released into the inner cavity 300.

In order to release the release lug 210, the plunger can be moved or withdrawn from beneath the release lug 210 (shown by the arrow 304 in FIG. 2). Accordingly, in the unreleased configuration, the plunger is in a first position as shown in FIG. 2, but can be moved in the direction of arrow 304 to a second position, thus releasing the release lug 210.

Shown in FIG. 2 is electromechanical actuator 310. The electromechanical actuator 310 actuates to release the release lug 210. For example, the electromechanical actuator 310 can actuate to shift the plunger 302 from the first position to the second position to release the release lug 210. The electromechanical actuator 310 can be any electrically actuated mechanical device. In some examples, the electromechanical actuator 310 can have an electrical motor. In particular, the electromechanical actuator 310 can have a stepper motor, or a stepper motor with a linear drive, for example employing a lead screw to provide a linear drive. Alternatively, the electrical drive motor can be a Piezoelectric motor.

Figure 3A:
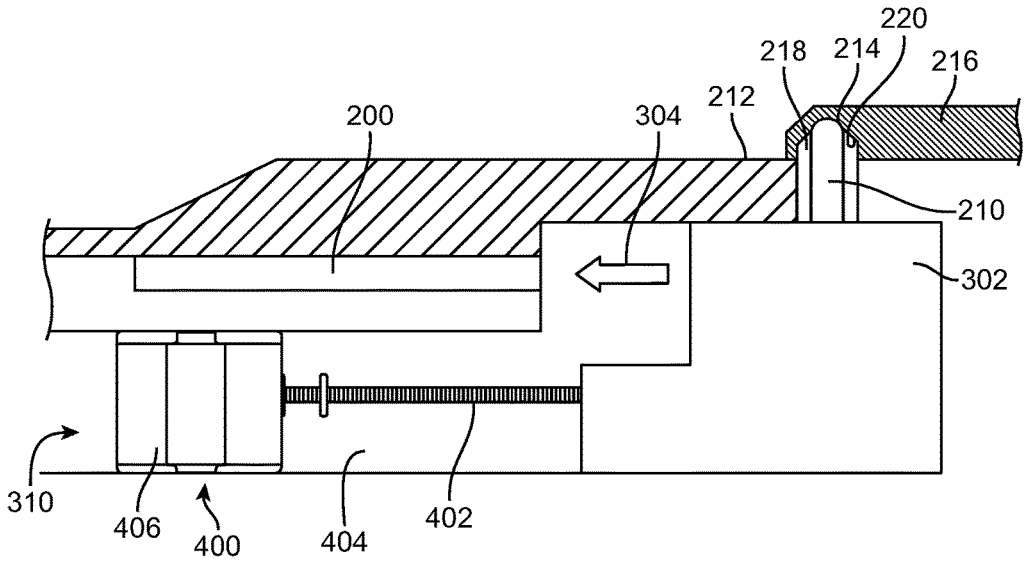
FIG. 3A is a diagram illustrating an exemplary electromechanical actuator prior to activation.
Figure 3B:
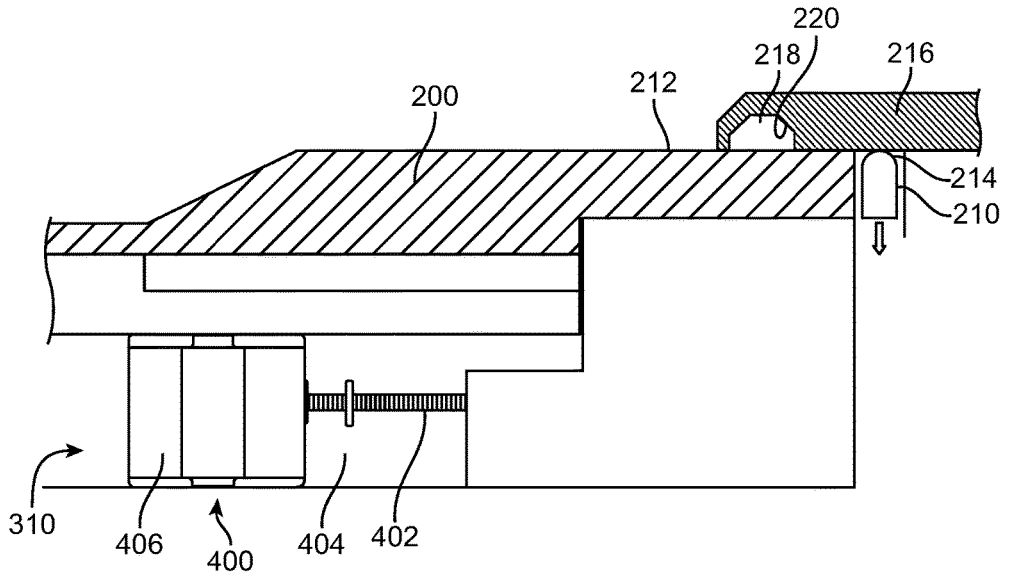
FIG. 3B is a diagram illustrating an exemplary electromechanical actuator after activation.

As exemplary electromechanical actuator drive motor is shown in FIGS. 3A and 3B. In particular, a stepper motor linear actuator (SMLA) 400 is shown in FIG. 3A. The SMLA has a lead screw 402 extending through a bore 404 to the plunger 302 of the inner cavity 300. The lead screw 402 is threaded and is rotated by the SMLA 400. The housing 406 of the SMLA 400 as well as the plunger are held in place, e.g. their rotation within inner cavity 300 is resisted by the body 200 of the pulling tool 150. Because they are held in place, as the lead screw 402 rotates, the plunger 302 is drawn along the lead screw 402 toward the housing 406 of the SMLA in the direction shown by the arrow 304. When the plunger 302 moves sufficiently out of the way, as shown in FIG. 3B, the release lug 210 will then release and fall below the surface 212 of the pulling tool 150. The sleeve 216, due to the bias 226 urging the cam surface 214 and 220 against one another, the release lug 210 is forced downward toward the inner cavity 300.

Figure 4:
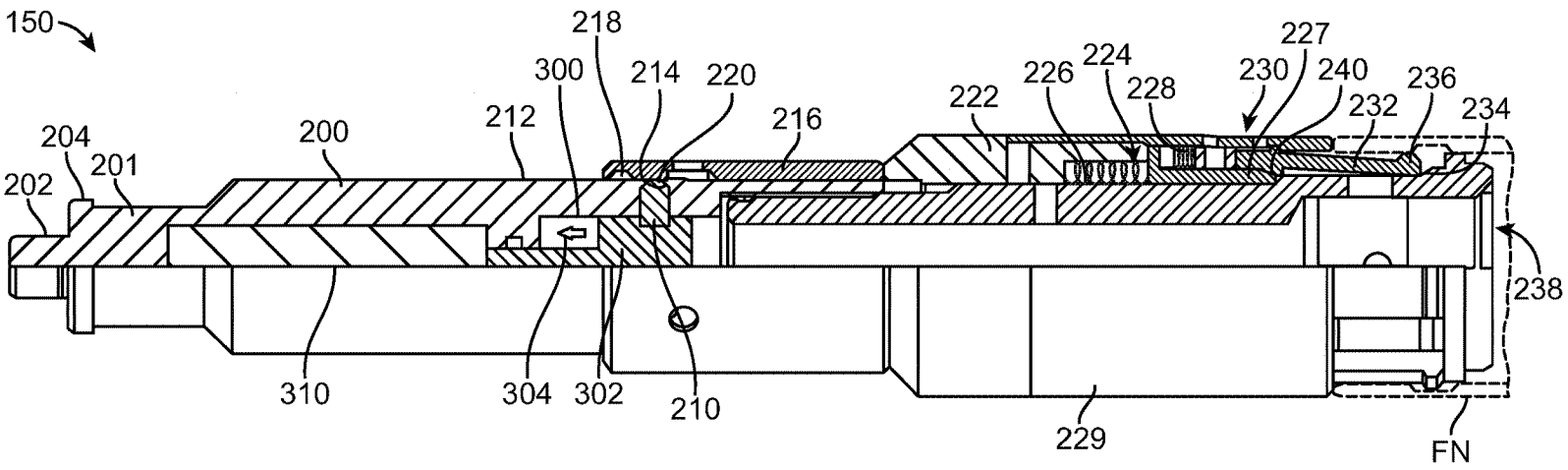
FIG. 4 is a diagram illustrating an exemplary pulling tool after actuation and release of the pulling tool.

With the release of the release lug 210 as shown in FIG. 3B, the sleeve 216 is urged upward toward the top end of the pulling tool 150. When this occurs, as shown in FIG. 4, bias 226 overcomes the strength of the weaker bias 228, which is then compressed, and the sleeve 216 and skirt 222 are pushed upwardly. The upward movement of the skirt lifts up and retracts the dogs 232. For example, as the skirt 222 lifted up, the upper portion of dogs 232 engage the spacer cam surface 240, causing the lower portion of the dogs 232 to be retracted inward. As a result, the pulling tool 150 is released from the fishing neck FN of a lock mandrel of a downhole device.

Figure 5:
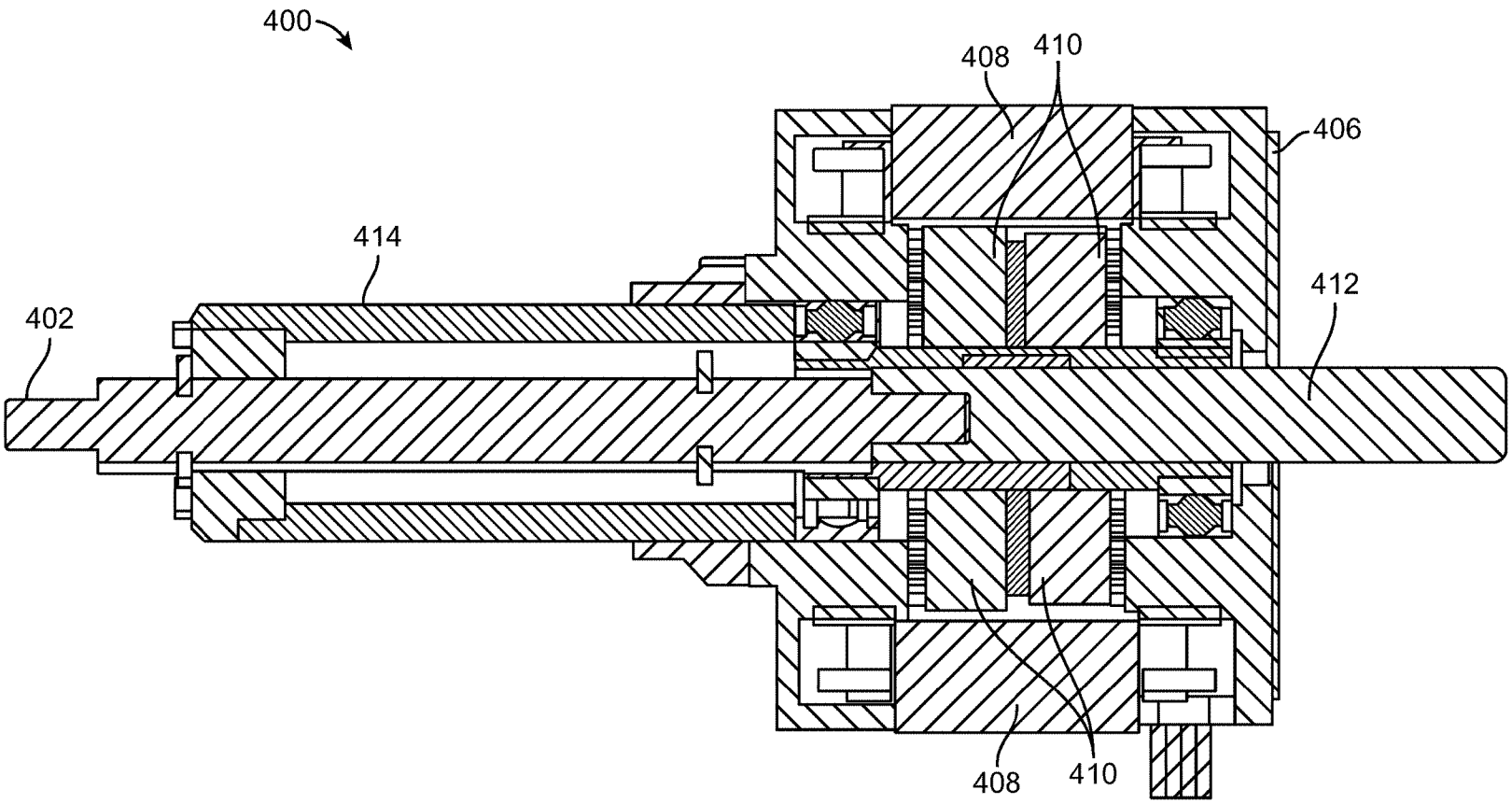
FIG. 5 is a diagram illustrating an exemplary pulling tool after actuation and release of the pulling tool.

An exemplary SMLA 400 as an electromechanical actuator 310 is shown in FIG. 5 having a housing 406 and a lead screw 402. The SMLA 400 can have a stator 408 and magnets 410, for rotation of rotor 412. With rotation of the rotor 412, the lead screw 402 extending from protective sleeve 414 can be rotated and transfer linear motion to the plunger 302. The use of an electromechanical actuator permits unlimited jarring upwards or downwards when using the pulling tool 150 disclosed herein, as release from the lock mandrel fishneck only occurs when the electromechanical actuator is actuated rather than when certain jarring severs a shear pin. Thus, an operator on the surface can have more control of the pulling tool with respect to release, and more control during jarring sequences because the operator can jar with any sequence or force within limits of the system without fear of premature release.

Figure 6:
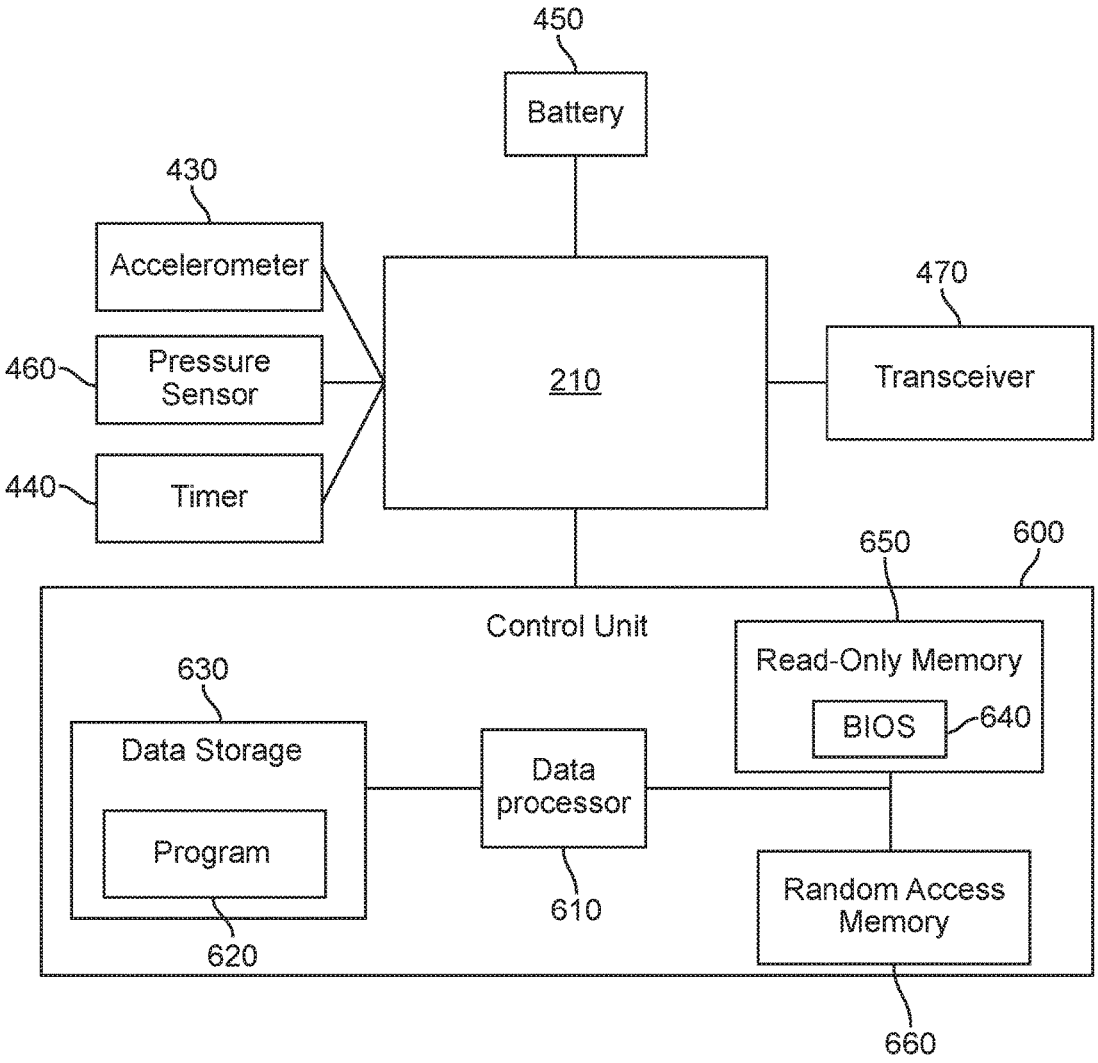
FIG. 6 is a diagram of an exemplary stepper motor for an electromechanical actuator.

As illustrated in FIG. 6, the electromechanical actuator 210 (which can be SMLA 400 for example) can be powered by a rechargeable battery 450. The battery can be inside or outside of a housing of the electromechanical actuator 210. The battery 450 can be recharged on the surface prior to placing the pulling tool 150 in a wellbore. The battery 450 can power the actuation of the electromechanical actuator 210.

Furthermore, the electromechanical actuator 210 may also have a control unit 600, which can be within or without the housing 406. The control unit 600 can be a general purpose digital computer having a processor 610 which can process data and execute instructions of a program 620 stored in a non-transitory data storage 630. For example, the data storage 630 can be a hard disk drive in the control unit 600. Basic input/output routines (BIOS) 640 stored in read-only memory 650 provide basic routines that help to transfer information between elements within the control unit 600, such as during start-up. The control unit 600 can have a random access memory 660. The control unit 600 can have an input device for communication by an operator and optionally a graphic user interface. Alternatively, an operator can attach conductive connectors (e.g. jumper cables) to the control unit 600 or portion of the pulling device, and communicate with the control unit 600 using an additional computer or handheld computer device.

The electromechanical actuator 210 can actuate based on predetermined conditions or variables, whether detected from the environment or preset in electromechanical actuator 210 or preprogrammed in control unit 600. The electromechanical actuator 210 can be actuated with the use of the control unit 600, or without the use of a control unit.

In some examples, the electromechanical actuator 210 can be activated with the use of a timer 440. The timer 440 can be any device which activates the electromechanical actuator 210 after a predetermined time. The timer can be analog or digital, and can include a timer programmed into the control unit 600. For example, the pulling tool 150 can be taken apart at the surface, and the timer set to 1-8 hours for example, or other times, for example, 0.5 hours, 1.5 hours, 2 hours, 2.5 hours, 3 hours or more, or other increments or time frames. The pulling tool 150 can then be reassembled and placed downhole. Upon setting of the timer, the surface operators would therefore know that they have the present time in which to conduct operations of running, pulling, jarring or other operations. After lapse of the pre-set time limit, the timer activates the electromechanical actuator 210 which then actuates and releases the release lug 210.

In some examples, the electromechanical actuator can be communicatively coupled with an accelerometer 430. With the use of an accelerometer 430, the electromechanical actuator can actuate to release the release pin after a particular jarring sequence or jarring force. For example, a jarring sequence can include jarring downward, and then upward, or alternatively, downward, upward, and then downward again, or any repetition or reverse of these, or any other jarring sequence. Further, the jars which are sensed or recorded for the purpose of counting toward the sequence, can be only those having a predetermined jarring force. Furthermore, the control unit 600 can be programmed to have a particular jarring sequence input or modified a surface operator. The accelerometer 430 can be used to sense each jarring motion, and then communicate the same to the control unit 600 and/or the electromechanical actuator. By this illustration, an operator could know in advance and with which force a sequence will effectuate a release of the pulling tool.

Figure 7A:
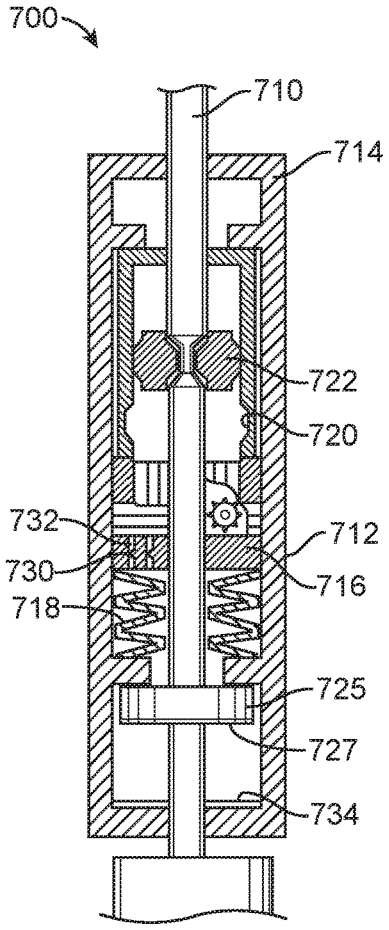
FIG. 7A is a diagram of a simplified upward jarring mechanism prior to actuation of an upward jarring.
Figure 7B:
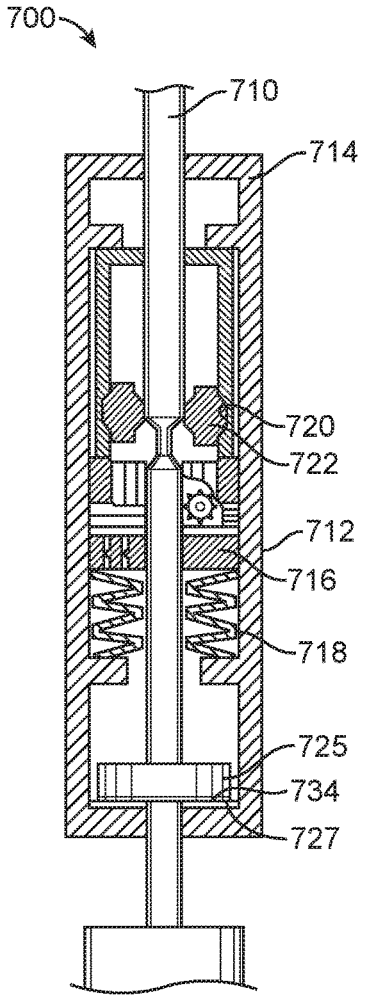
FIG. 7B is a diagram of a simplified upward jarring mechanism subsequent actuation of an upward jarring.
Figure 7C:
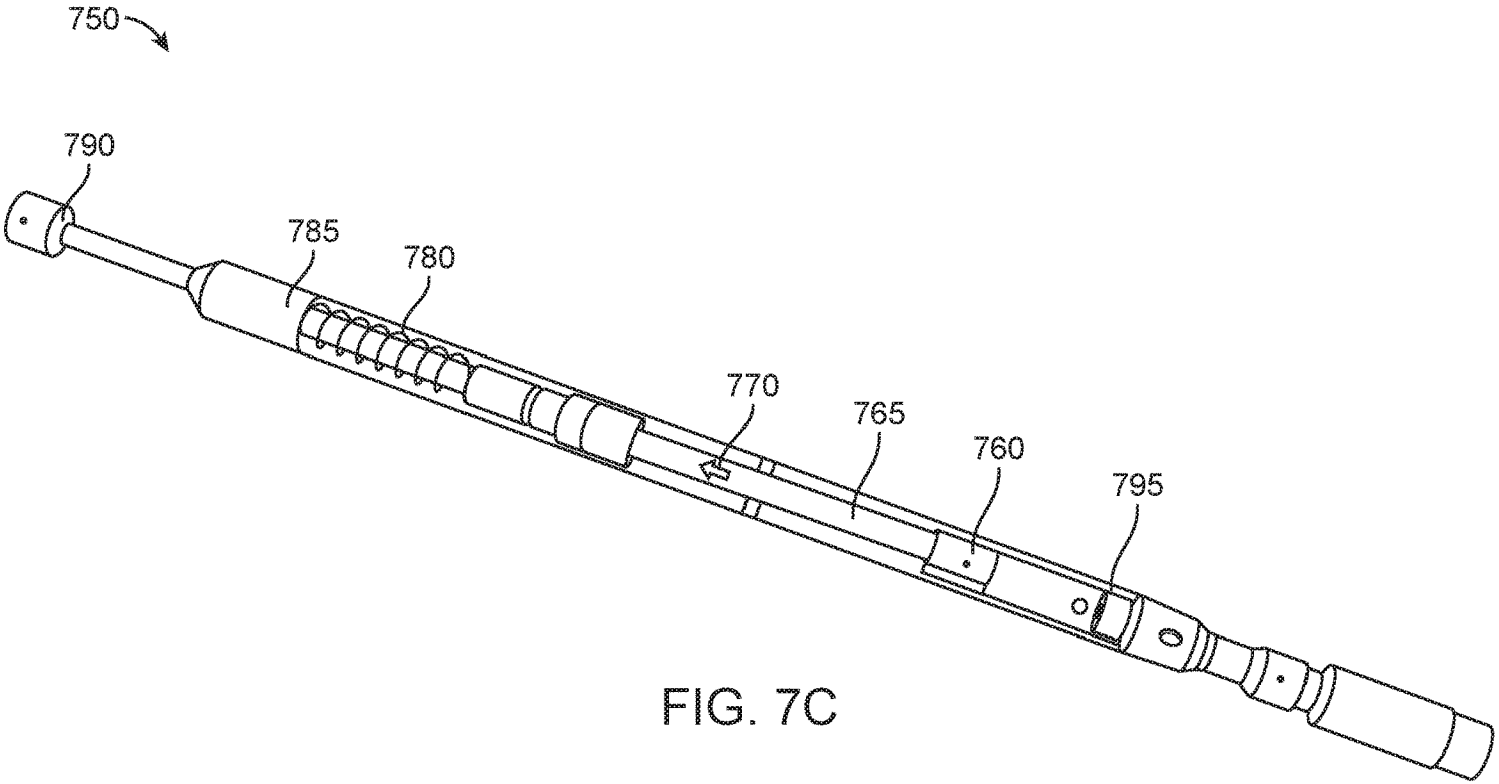
FIG. 7C is a diagram of a simplified downhard jarring mechanism.

FIGS. 7A-7C illustrates simplified jars devices which can be attached to the wireline above the pulling tool 150. Jars are employed to "jar," i.e, apply a sudden force, in the upward or downward direction. This can aid in releasing a stuck downhole device or releasing or attaching other devices. As shown in FIGS. 7A and 7B is a jar device 700 for jarring upward. A mandrel 710 extends through a housing 712 with a top plate 714. A piston 716 is secured to the mandrel 710 and is biased in the upward position by a bias springs 718. A collet mechanism 722 is supported on the mandrel 710 and when aligned with recess 720 allows radial motion of the collet mechanism 722 into the recess 720. An anvil 725 is secured to the mandrel 710 and has anvil surface 727. A metering device 730 meters fluid from the lower chamber below the piston 716 to the upper chamber above the piston through flow path 732. When actuated, the housing 712 moves upward relative the mandrel 710 due to the force of bias springs 718. The hammer surface 734 within the housing strikes the anvil surface 727 causing an upward jarring force.

FIG. 7C illustrates a simplified downward jarring device 750. The downward jarring device 750 has an anvil 760 attached to a shaft 765. When pulled in the direction of arrow 770, the spring bias 780 compresses against plate 785. As the spring bias 780 compresses energy is stored, and upon release urges the anvil 760 against hammer surface 795, thus creating a downward jarring force. OTIS® jars tools by Halliburton Energy Services, Inc., can be used for conducting jarring and jarring sequences.

The pulling tool 150 may also transmit and receive data via acoustic telemetry. For example, the electromechanical actuator can actuate and release the release lug upon command from the surface. Referring back to FIG. 1, a surface control unit 900 (having similar computer components as control unit 605) can be electronically coupled to an acoustic transceiver 705 at the surface 103. The acoustic transceiver 705 transmits and receives acoustic signals conducted via the ground, the casing, or fluid contained within the wellbore, or casing or tubing in the wellbore, to and from the pulling tool 150 tool lowered below the surface 112 in the production casing 116. For example, pressure pulse communications can be employed. The electromechanical actuator 210 can be communicatively coupled to a transceiver 470 (FIG. 6) which can also receive signals, and although not required, may also transmit signals from the acoustic receiver 705. A surface control unit 900 can be used by a surface operator to actuate the electromechanical actuator 210 to release the pulling tool by release of the release lug as described herein.

In some examples, the electromechanical actuator 210 can be activated by a particular pressure or pressure sequence. For example, the production tubing 106 can contain production fluid, which can include water, gas, hydrocarbons, saltwater, mud, formation fluid, or other fluid. Referring again to FIG. 1, a pump 129 can pump mud or other fluid into the production tubing 106. The pump 129 can be used to increase or decrease the pressure within the production tubing 106. Accordingly, a pressure sensor 460, such as a transducer, can be communicatively coupled to the electromechanical actuator 210 and/or control unit 600. The pressure sensor 460 can be employed to detect the pressure outside of the pulling tool 150 and within the vicinity of the pulling tool 150. The electromechanical actuator 210 can be preset to activate when the pressure reaches a certain predetermined value, for example 6,000-10,000 psi, or 7,000-8,000 psi, or for example 7,500 psi. Alternatively, the electromechanical actuator 210 can be preset to activate based on a sequence of predetermined pressures. For example, pressure can be brought to 3,000 psi and held for a period of time (e.g., 1-20 mins, or 10 mins), and then pressurized to 5,000 psi and held for an additional period of time (e.g., 1-20 mins, or 10 mins). Alternatively, other pressures can be employed from 1,000 psi-10,000 psi, or other pressures, and for other periods of time, or for different pressure sequences. For example, the pressure can be increased at several increments and held at a particular period of time, or increased, then decreased, or alternatively increased, then decreased, and then increased again. These can be repeated or reversed as desired. Such sequences or target pressure(s) can be pre-programmed for example into control unit 600. When such target pressures or pressure sequences are detected by the pressure sensor 460, the electromechanical actuator can be active to release the release lug and therefore retract dogs and release pulling tool 150.

In other examples, each of the accelerometer 430, pressure sensor 460, timer 440, transceiver 470, battery 450, and control unit 600 can be used and communicatively coupled together with the electromechanical actuator 210 or can individually be connected or altogether or one or more of each.

The electromechanical actuator 210 also need not include an electrical motor. For example, a bias can be disposed to urge the plunger toward a second released position, while being held in place by a meltable pin. The pin may be made of a meltable metal, such as a low temperature melting metal, or a hard plastic. Electromechanical actuator 210 can include for example a battery 450, which heats and melts a pin, thereby releasing movement of the plunger 302 and release of the release lug 210.

Accordingly, the electromechanical actuator can be activated by any number of preset conditions or variables, or received signals. The ability to actuate release the pulling tool 150 based on predetermined criteria rather than jarring motions to shear a pin permit use of the pulling tool for specialized equipment. For example, some downhole devices do not tolerate well jarring. For example, if the downhole device has sensitive equipment or sensors, jarring can be avoided. For example, bomb hangers are used via wireline to conduct recordings, and may contain sensitive equipment. An operator can elect to actuate release via a timer, or on command or pressure, or pressure sequence or other preset condition or variable rather than by jarring which may damage the downhole device.

Figure 8:
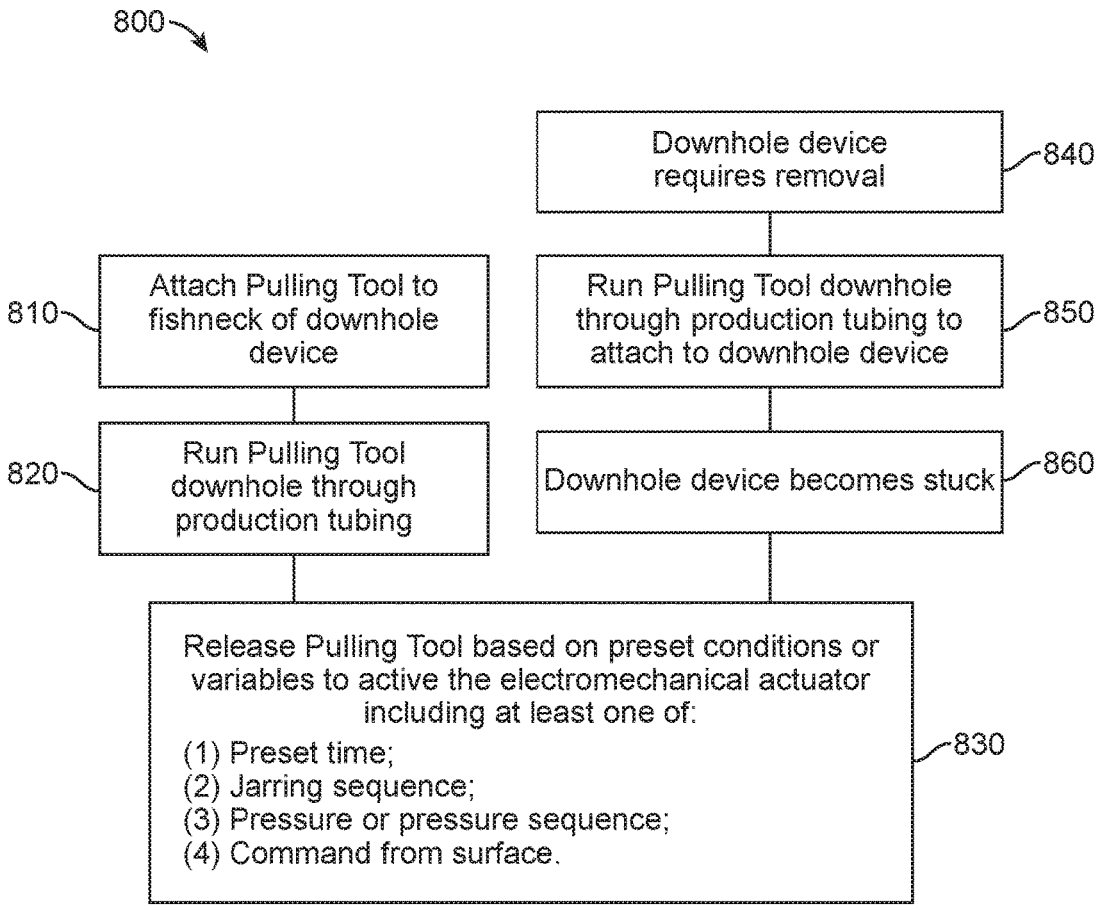
FIG. 8 is a flow diagram of employment of a pulling tool according to the present disclosure.

Actuation and release of the pulling tool 150 can follow the flow diagram 800 depicted in FIG. 8. For example beginning in step 810, a pulling tool can attached to the fishneck of a downhole device. In step 820, the pulling tool is used to the downhole device to the desired position downhole, for example through production tubing. As shown in step 830, the pulling tool is then released from the downhole device. Alternatively, or additionally, if a downhole device must be retrieved as shown in step 840, the pulling tool can be run downhole, through production tubing for example, as shown in step 850 and attached to the fishneck of the downhole device or a lock mandrel attached to the downhole device. Upon retrieval of the downhole device, it can be come stuck as shown in step 860. Accordingly, at step 820 or step 860, the pulling tool requires release from the fishneck of the downhole device. In order to release the pulling tool, the electromechanical actuator is activated as in step 870, by a number of present conditions or variables. For example, this can include a setting a timer, or providing a particular jarring sequence, or achieving a particular pressure or sequence of pressures, or a command from the surface. With activation, the Numerous examples are provided herein to enhance understanding of the present disclosure. A specific set of examples are provided as follows.

In a first example, there is disclosed a drilling well pulling tool including a longitudinal body having an inner cavity; a sleeve slideably disposed about a portion of the longitudinal body, the sleeve moveable from a first position to a second position; a dog member retractable from an extended position to a retracted position relative the body when the sleeve is moved from the first position to the second position; a release lug abutting and resisting movement of the sleeve from the first position, the lug releasable to the inner cavity thereby permitting slideable movement of the sleeve; and an electromechanical actuator releasing the release lug upon actuation.

In a second example, a method is disclosed according to the preceding example wherein a bias is disposed to urge the sleeve toward the second position.

In a third example, a method is disclosed according to any of the preceding examples wherein the electromechanical actuator has an electric motor.

In a fourth example, a method is disclosed according to any of the preceding examples, wherein the electromechanical actuator is a stepper motor with a linear drive.

In a fifth example, a method is disclosed according to any of the preceding examples, wherein a plunger is disposed within the cavity and maintains the release lug in an unreleased position abutting and resisting movement of the sleeve.

In a sixth example, a method is disclosed according to any of the preceding examples, wherein actuation of the electric motor withdraws a plunger thereby releasing the release lug.

In a seventh example, a method is disclosed according to any of the preceding examples, wherein a timer is communicatively coupled with the electromechanical actuator, the timer settable to actuate the electromechanical actuator after a predetermined time.

In an eighth example, a method is disclosed according to any of the preceding examples, wherein the electromechanical actuator releases the release lug according to a preset condition.

In a ninth example, a method is disclosed according to any of the preceding examples, wherein the preset condition includes a predetermined pressure, or a sequence of predetermined pressures.

In a tenth example, a method is disclosed according to any of the preceding examples, wherein the preset condition is a predetermined jarring sequence of the pulling tool.

In an eleventh example, a method is disclosed according to the tenth example, wherein the jarring sequence is sensed by an accelerometer.

In a twelfth example, a method is disclosed according to any of the preceding examples, wherein a control unit is provided within the body and configured to communicate an instruction to the electromechanical actuator to actuate release of the release lug.

In a thirteenth example a method is disclosed according to any of the preceding examples, wherein the electromechanical actuator actuates upon command from a surface communication device.

In a fourteenth example, a well system is disclosed having a wellbore and a pulling tool disposed within the wellbore, the pulling tool including: a longitudinal body having an inner cavity; a sleeve slideably disposed about a portion of the longitudinal body, the sleeve moveable from a first position to a second position; a bias is disposed to urge the sleeve toward the second position; a dog member retractable from an extended position to a retracted position relative the body when the sleeve is moved from the first position to the second position; a release lug abutting and resisting movement of the sleeve from the first position, the lug releasable to the inner cavity thereby permitting slideable movement of the sleeve; and an electromechanical actuator releasing the release lug upon actuation.

In a fifteenth example, a method is disclosed according to the fourteenth example, wherein the pulling tool has a bias within disposed to urge the sleeve toward the second position.

In a sixteenth example, a method is disclosed according to the fourteenth or fifteenth examples, wherein the electromechanical actuator is a stepper motor with a linear drive.

In a seventeenth example, a method is disclosed according to the fourteenth to the sixteenth examples, wherein a plunger is disposed within the cavity and maintains the release lug in an unreleased position abutting and resisting movement of the sleeve, and upon actuation the electric motor withdraws the plunger thereby releasing the release lug.

In an eighteenth example, a method is disclosed according to the fourteenth to the seventeenth examples, wherein a timer is communicatively coupled with the electromechanical actuator, the timer settable to actuate the electromechanical actuator after a predetermined time.

In a nineteenth example, a method is disclosed according to the fourteenth to the eighteenth examples, wherein the electromechanical actuator releases the release lug according to a preset condition.

In twentieth example, a method is disclosed according to the fourteenth to the nineteenth examples, wherein the preset condition is selected from at least one of a predetermined pressure, a sequence of different predetermined pressures, a jarring sequence of the pulling tool.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A drilling well pulling tool comprising:

a longitudinal body having an inner cavity;

a sleeve slideably disposed about a portion of the longitudinal body, the sleeve moveable from a first position to a second position;

a dog member retractable from an extended position to a retracted position relative to the body when the sleeve is moved from the first position to the second position;

a release lug abutting and resisting movement of the sleeve from the first position, the lug releasable to the inner cavity thereby permitting slideable movement of the sleeve;

a plunger is disposed within the cavity and maintains the release lug in an unreleased position abutting and resisting movement of the sleeve; and an electromechanical actuator coupled with the plunger via a longitudinal shaft and shifts the plunger releasing the release lug upon actuation, wherein the electromechanical actuator and the plunger are contained within the longitudinal body of the pulling tool.

2. The pulling tool of claim 1, wherein a bias is disposed to urge the sleeve toward the second position.

3. The pulling tool of claim 1, wherein the electromechanical actuator has an electric motor.

4. The pulling tool of claim 3, wherein the electromechanical actuator is a stepper motor with a linear drive.

5. The pulling tool of claim 3, wherein actuation of the electric motor withdraws the plunger thereby releasing the release lug.

6. The pulling tool of claim 1, wherein a timer is communicatively coupled with the electromechanical actuator, the timer settable to actuate the electromechanical actuator after a predetermined time.

7. The pulling tool of claim 1, wherein the electromechanical actuator releases the release lug according to a preset condition.

8. The pulling tool of claim 7, wherein the preset condition includes a predetermined pressure, or a sequence of predetermined pressures.

9. The pulling tool of claim 7, wherein the preset condition is a predetermined jarring sequence of the pulling tool.

10. The pulling tool of claim 9, wherein the jarring sequence is sensed by an accelerometer.

11. The pulling tool of claim 9, wherein a control unit is provided within the body and configured to communicate an instruction to the electromechanical actuator to actuate release of the release lug.

12. The pulling tool of claim 9, wherein the electromechanical actuator actuates upon command from a surface communication device.

13. The drilling well pulling tool of claim 1, wherein the electromechanical actuator and plunger are contained within the inner cavity of the longitudinal body of the pulling tool.

14. A well system having a wellbore and a pulling tool disposed within the wellbore, the pulling tool comprising:

a longitudinal body having an inner cavity;

a sleeve slideably disposed about a portion of the longitudinal body, the sleeve moveable from a first position to a second position;

a bias is disposed to urge the sleeve toward the second position;

a dog member retractable from an extended position to a retracted position relative to the body when the sleeve is moved from the first position to the second position;

a release lug abutting and resisting movement of the sleeve from the first position, the lug releasable to the inner cavity thereby permitting slideable movement of the sleeve;

a plunger is disposed within the cavity and maintains the release lug in an unreleased position abutting and resisting movement of the sleeve;

an electromechanical actuator coupled with the plunger via a longitudinal shaft and shifts the plunger releasing the release lug upon actuation, wherein the electromechanical actuator and the plunger are contained within the longitudinal body of the pulling tool.

15. The pulling tool of claim 14, wherein the electromechanical actuator is a stepper motor with a linear drive.

16. The pulling tool of claim 14, wherein a timer is communicatively coupled with the electromechanical actuator, the timer settable to actuate the electromechanical actuator after a predetermined time.

17. The pulling tool of claim 14, wherein the electromechanical actuator releases the release lug according to a preset condition.

18. The pulling tool of claim 17, wherein the preset condition is selected from at least one of a predetermined pressure, a sequence of different predetermined pressures, or a jarring sequence of the pulling tool.

19. The pulling tool of claim 14, wherein the electromechanical actuator actuates upon command from a surface communication device.

* * * * *